US006948438B2

(12) United States Patent
Takahashi et al.

(10) Patent No.: US 6,948,438 B2
(45) Date of Patent: Sep. 27, 2005

(54) SEWING MACHINE

(75) Inventors: Yoshitaka Takahashi, Tokyo (JP); Takehiro Kodama, Tokyo (JP); Shunichi Okaya, Tokyo (JP); Koshiro Omiya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/895,656

(22) Filed: Jul. 21, 2004

(65) Prior Publication Data

US 2005/0028716 A1 Feb. 10, 2005

(30) Foreign Application Priority Data

Aug. 5, 2003 (JP) ..... 2003-287046

(51) Int. Cl.[7] ..... D05B 3/02
(52) U.S. Cl. ..... 112/458; 112/475.18
(58) Field of Search ..... 112/458, 80.01, 112/80.23, 80.24, 470.01, 459, 475.18

(56) References Cited

U.S. PATENT DOCUMENTS 4,598,657 A * 7/1986 Makabe et al. ..... 112/275
4,628,845 A * 12/1986 Matsuda ..... 112/259
5,097,779 A * 3/1992 Ishikawa et al. ..... 112/445
5,319,565 A * 6/1994 Hausammann et al. ..... 700/131
5,363,783 A * 11/1994 Hori et al. ..... 112/470.04

* cited by examiner

*Primary Examiner*—John Calvert
*Assistant Examiner*—Brian Kauffman
(74) *Attorney, Agent, or Firm*—Nields & Lemack

(57) ABSTRACT

Disclosed is a sewing machine having a pattern selecting device including a pattern selecting dial and an electronic indicator for indicating a pattern selected by the pattern selecting device. More particularly, the pattern selecting device includes a mode switch 2 which is rotated by a pattern selecting dial 5 and has a plurality of switches Sw arranged in coaxial circles, a plurality of projections 2*c* arranged in coaxial circles, and an electronic indicator 10. A pattern is optionally selected by the projections 2*c* and switches Sw which are turned on in optional combination by rotation of the mode switch 2, and the selected pattern is indicated at the electronic indicator 10.

11 Claims, 5 Drawing Sheets

SEWING MACHINE

BACKGROUND OF THE INVENTION AND RELATED ART STATEMENT

1. Field of the Invention

The present invention relates to a swing machine having a dial which is operated to select and indicate a pattern to be stitched.

2. Prior Art

Recently, the sewing machine has come to have a lot of patterns stored therein as programmed under control of a computer such that the patterns may be optionally selected to form an optional combination of patterns or to form embroidery patterns. The selected pattern or patterns may be indicated in an electronic indicator including liquid crystal and may be visually confirmed prior to starting stitching operation, and thus the errors in stitching operation may be prevented.

It is generally known that the sewing machine has a pattern selecting means, for example, such as a dial operation type, a touch switch type, a numeral input type and so on. The pattern selecting means of a touch switch type or a numeral input type is generally so formed as to electrically control the production of patterns which are selected normally in a computer controlled sewing machine. The pattern selecting means of a dial operation type is disclosed, for example, in the Japanese patent laid open No. 50-133051. This pattern selecting means includes pattern cams which may be optionally selected by operation of a dial normally in a mechanically controlled sewing machine.

In the recent years, the switches of electronic parts such as a push button, a touch panel and the like are often used in computerization of sewing machine. However it must be recognized that these electronic Switches are something alien to the machine users who have long been accustomed to a specific operation, for example, in the mechanically controlled sewing machines. Namely, it is a fact that the dial operation type as disclosed, for example, in the Japanese patent laid open No. 50-133051 is familiar to the machine users.

As to the pattern selecting means of dial operation type, a device has been proposed, wherein a dial is rotated to detect the rotation quantity which is used to designate a pattern information, or a dial is rotated to detect the angular position which is converted to an electric signal for indicating a pattern information at an indicator. Such pattern selecting means may be employed in a mechanical pattern producing device or in a computer controlled pattern producing device.

However, the pattern selecting means of dial operation type is generally of a photo-detecting system or of a magnetic detecting system. The mechanism is, therefore, rather complex and expensive. Especially in case the number of patterns is increased, the angular region to be detected per pattern is necessarily narrow in pattern selection, and the errors may easily happen in selection of pattern and/or in operation of the dial. Thus the pattern selecting means of dial operation type is mechanically unsuitable for selection of increased number of patterns.

OBJECTS OF THE INVENTION

It is, therefore, an object of the invention to provide a sewing machine having a pattern selecting device of dial operation type which is comparatively simple in structure and easy in operation for exactly selecting many patterns.

SUMMARY OF THE INVENTION

The invention is provided with a dial which is operated to select a pattern to be stitched, the sewing machine comprising a signal producing means which is activated in association with operation of the dial to produce a code signal for a pattern selected by the dial, and a pattern indicating means which is activated in response to the code signal from the signal producing means to indicate thereat the selected pattern. The signal producing means includes a plurality of switches which are arranged in coaxial circles and turned on and off with rotation of the dial, thereby to produce the code signal. Thus the signal producing means is simple in structure and exact in operation.

In the outermost one of the coaxial circles, there are arranged the switches which are turned on and off so many times as the number of patterns to be selected in one complete rotation. The switches are turned on to make effective a code signal which is produced by the switches of the other coaxial circles which are turned on and off. With such structure, a high precision is not required in the timing of on and off of the other switches, and therefore, errors in operation may be prevented. Further in case the pattern selecting device is of mechanical structure, it is preferred to arrange the switches of the outermost circle to be in agreement with the angular positions of the dial which is rotated to select patterns. Thus the pattern selection and the pattern indication may be simultaneously performed.

In a preferred embodiment, the plurality of switches are turned on and off by the projections arranged in coaxial circles on the rear side of the dial, such that a signal may be produced directly by operation of the dial.

Further, the patterns which may be selectable are divided in a plurality of groups such that a pattern group may be optionally selected by a pattern group selecting means. The dial is rotated to optionally select one of the patterns of the selected pattern group. According to the invention, a cloth feed selecting means may be provided for selecting a cloth feeding operation which is different than the cloth feeding operation of normal stitching mode, so as to increase the number of patterns to be stitched. In this case, the signal producing means produces a code signal having a signal added thereto corresponding to the selected pattern group or corresponding to the selected cloth feeding operation.

Incidentally, in case the pattern selection is made by operation of a dial, cams may be used, or digital data may be used for patterns to be selected. In case of the latter, the pattern selection may be made by a code signal from the signal producing means.

(*a*) is a perspective view of a rotational body which is one of the essential elements of the mechanism of the invention;

(*b*) is a front elevational view of the rotational body showing one phase thereof:

(*c*) is a front elevational view of the rotational body showing another phase thereof: and (*d*) is a side elevational view of the rotational body shown in vertical section.

FIG. 5

(*a*) and (*b*) are diagrammatic views of the relations between the patterns to be selected and the code signals produced by a plurality of switches which are turned on and off.

DETAILED DESCRIPTION OF PREFERRED EMBODIMENTS

Figure 1:
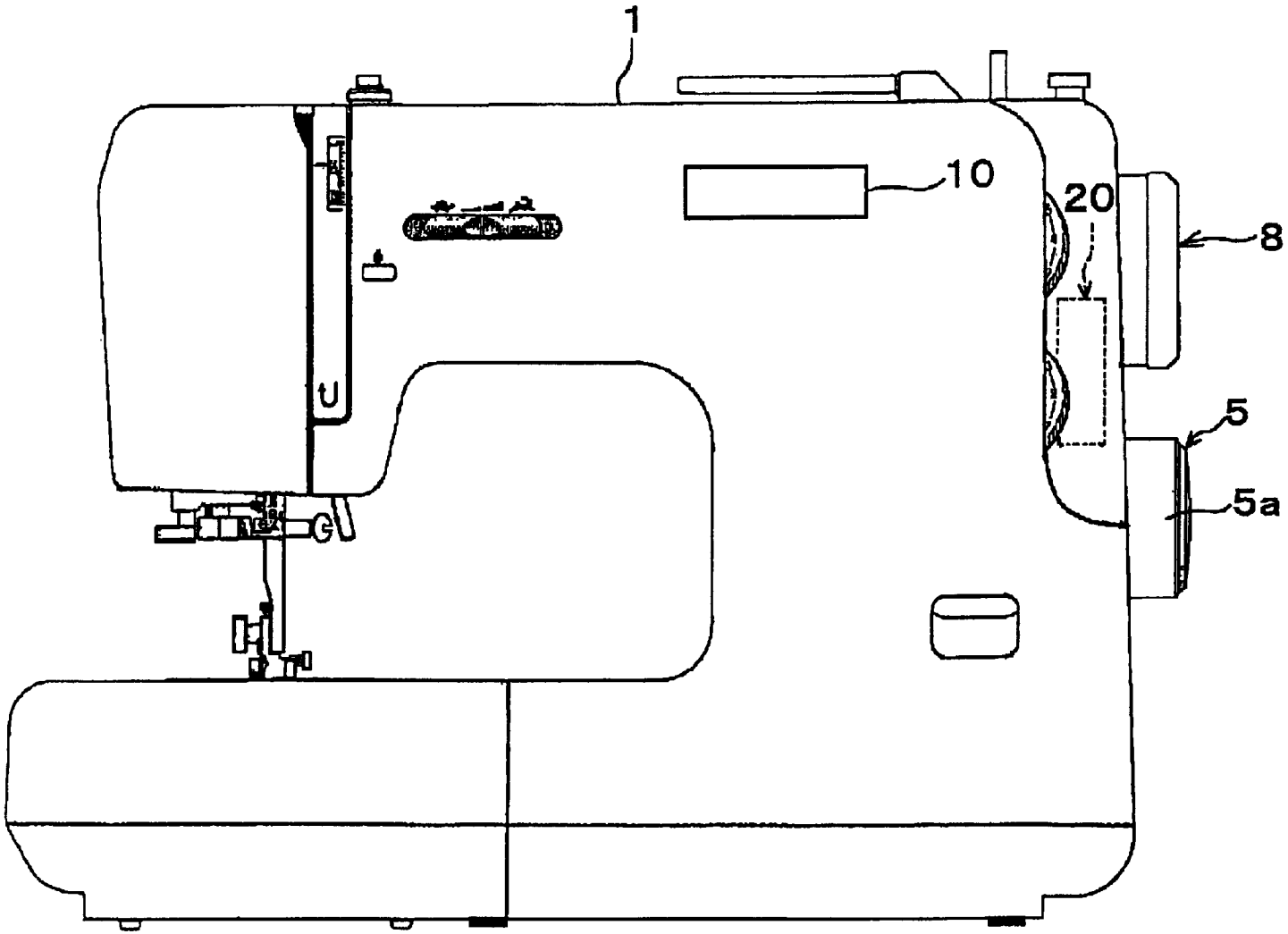
FIG. 1 is a side elevational view of a sewing machine of the invention.
Figure 2:
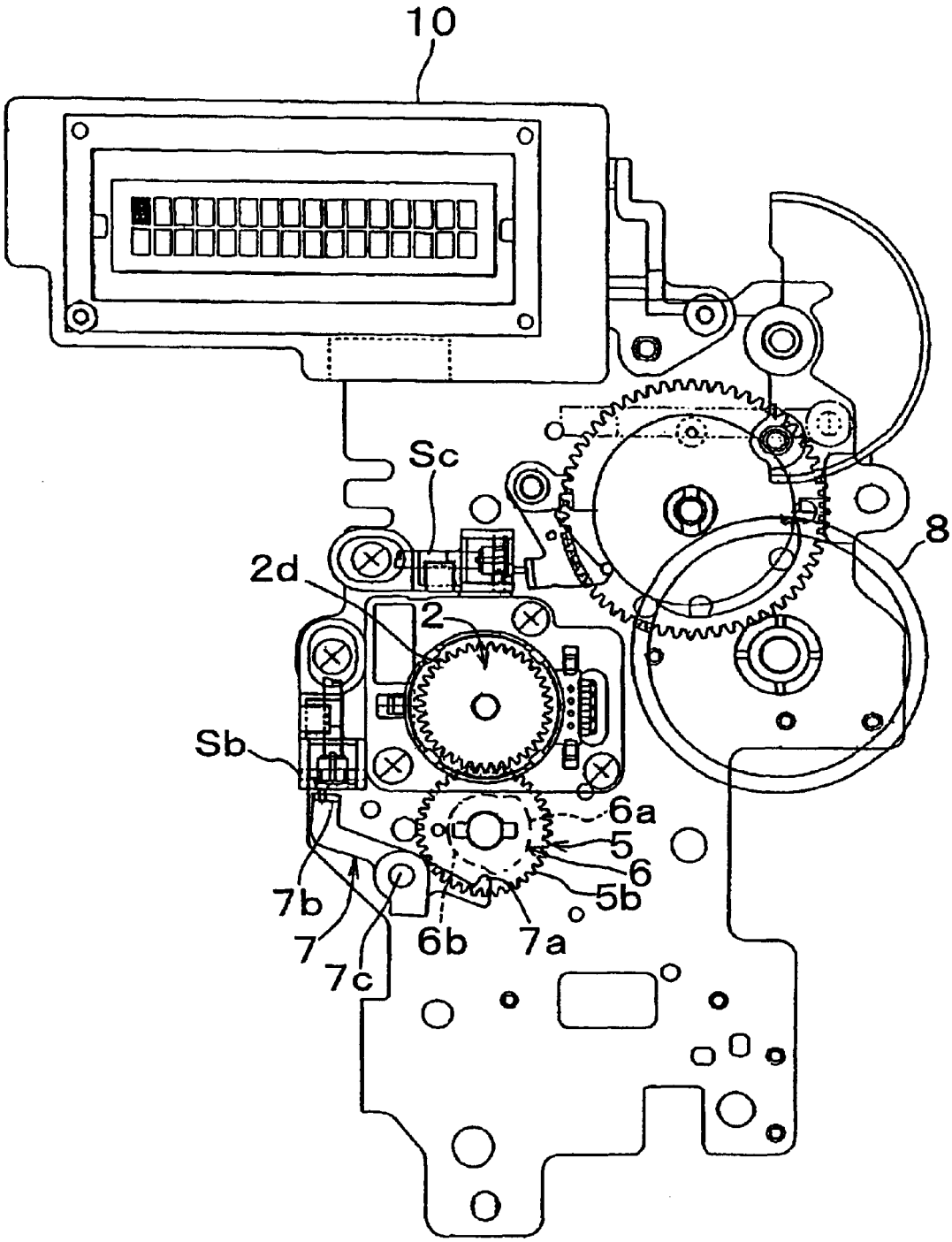
FIG. 2 is a side elevational view of a mechanism of the invention.
Figure 3:
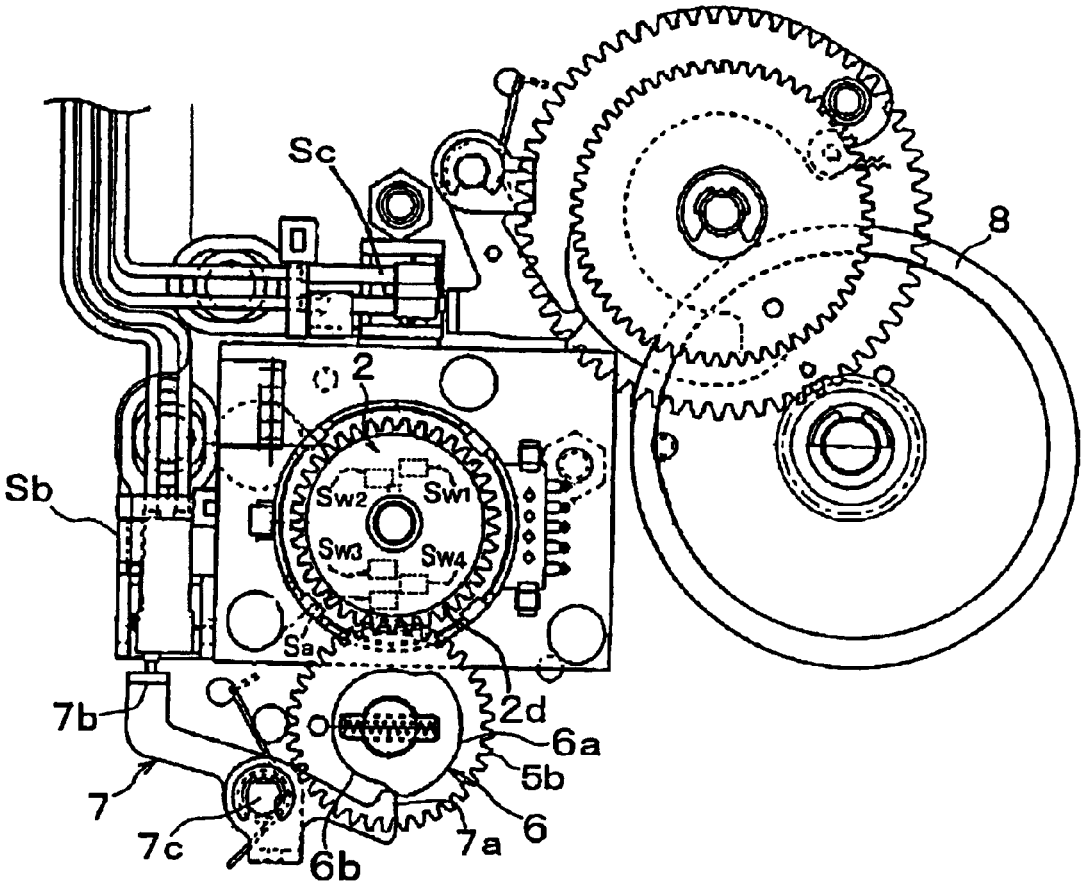
FIG. 3 is an enlarged view of an essential part of FIG. 2.

The invention will now be described in reference to the embodiment as shown in the attached drawings. In FIG. 1, a dial 5 is provided. so as to be rotated to select patterns to be stitched. A signal producing apparatus 20 is activated in association with rotation of the dial 5 to produce code signals for the selected patterns. Further in reference to FIG. 2, the signal producing apparatus 20 is activated to produce the code signals of selected patterns on the basis of the on/off signals from a mode switch 2, the on/off signals from a pattern group changing switch Sb and the on/off signals from a feed changing switch 8. An electronic indicator 10 is provided to indicate thereat the selected patterns designated by the code signals produced by the signal producing apparatus 20.

Figure 4:
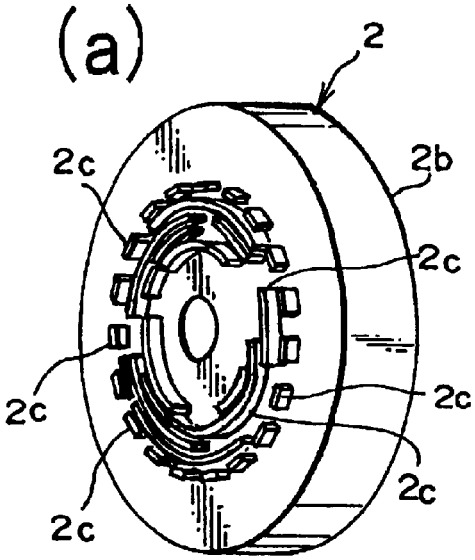
FIG. 4
Figure 4:
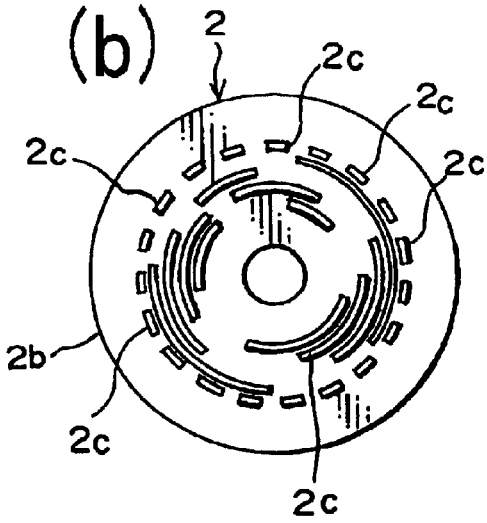
Figure 4:
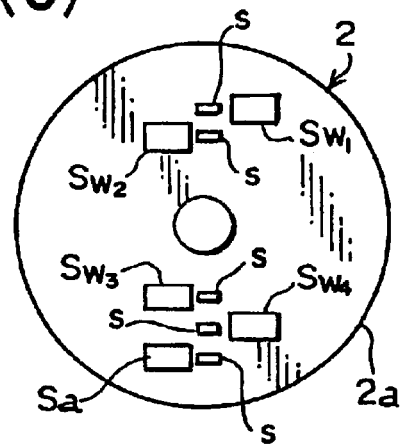
Figure 4:
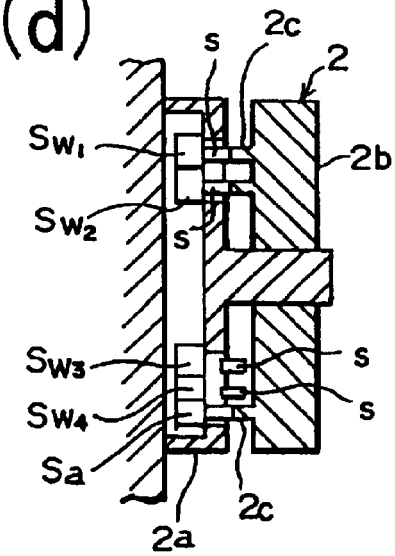

As shown in FIG. 4(*c*), the mode switch 2 is activated in association with rotation of the dial 5 which is operatively connected a cam mechanism for controlling the formation of various patterns. The mode switch 2 includes a plurality of switches Sw which may be turned on and off singly or in optional combination for selecting patterns and further includes a confirmation switch Sa.

As shown in FIG. 4, the mode switch 2 includes a base 2*a* and a disk 2*b* having a plurality of projections 2*c* formed thereon in a predetermined order. The disk 2*b* may be rotated relative to the base 2*a*.

The projections 2*c* are arranged on the rotational disk 2*b* coaxially with the rotational disk 2*b* with different radial distances. The projections 2*c* are operated to turn on and off the switches Sw in optional combination as the projections 2*c* are rotated with rotation of the disk 2*b* and are pressed against the contacts s of the switches Sw which are arranged on the base 2*a*.

The projections 2*c* are regularly arranged so as to turn on and off the switches Sw in optional combination with rotational operation of the dial 5, thereby to produce the code signals for the selected patterns. By optional combination, it is meant that more than two switches Sw are simultaneously turned on. However, it is not strictly limited to more than two switches Sw. One of the switches Sw may be turned on for pattern selection.

The switches Sw may be four (4) or five (5) in number that are arranged on the base 2*a*. In the embodiment, nineteen (19) types of patterns may be optionally selected. The mode switch 2 is designed to have five (5) switches Sw arranged thereon as shown in FIG. 4(*c*). The mode switch 2 is rotated with rotation of the dial 5. The dial 5 includes a dial body 5*a* having a drive gear 5*b* formed thereon which is in mesh with a follower gear 2*d* which is provided on the rotational disk 2*b* of the mode switch 2, such that the mode switch 2 may be rotated as the dial 5 is rotated.

One of the five switches is the confirmation switch Sa as mentioned above and the other four switches are detecting switches $Sw_1$–$Sw_4$. With the four detecting switches $Sw_1$–$Sw_4$ being provided, the methods of combination are $2^4$=16 and, therefore. 16 patterns may be selected. The switch Sa may be used for confirmation of the selected patterns.

As shown in FIG. 4(*c*), the confirmation switch Sa has a contact s arranged at a position radially farthest from the center axis of the base 2*a*. On the other hand, the rotational disk 2*b* has so many projections 2*c* arranged thereon in the outermost coaxial circle as corresponding to the number of patterns to be selected (19 patterns in the embodiment). Therefore, with one complete rotation of the rotational disk 2*b*, the projections 2*c* will turn the confirmation switch Sa on and off so many times as the number of patterns to be selected. By making effective the on-conditions of the detecting switches Sw when the confirmation switch Sa is turned on, the signals may be obtained in synchronism with rotation of the rotational disk 2*b*. Thus production of error signal may be prevented. Further, by making agreement the relation between the on-condition of the confirmation switch Sa and the pattern selection of the dial 5, the selection and indication of pattern may be simultaneously realized.

Further, by making effective the detecting switches $Sw_1$–$Sw_4$ by the on-condition of the confirmation switch Sa, the contacts of detecting switches $Sw_1$–$Sw_4$ and the corresponding projections 2*c* will get some degree of freedom as to the position thereof, and a correct signal may be obtained by the on and off condition of the confirmation switch Sa without being required to take care of strict positional regulation of the contacts and projections.

As mentioned above, the four detecting switches $Sw_1$–$Sw_4$ provide 16 methods of pattern selecting positions. According to the embodiment, a pattern group changing switch Sb is provided to enable the machine user to select and indicate the patterns, the number of which is 16×2=32.

Namely the patterns are divided into two groups (first pattern group $G_1$ and second pattern group $G_2$) which may be optionally selected by operation of the pattern group changing switch Sb.

The pattern group changing switch Sb is turned on and off by way of a transmission lever 7 which is in engagement with a cam 6 which is rotated in association with rotation of the dial 5.

Figure 5A:
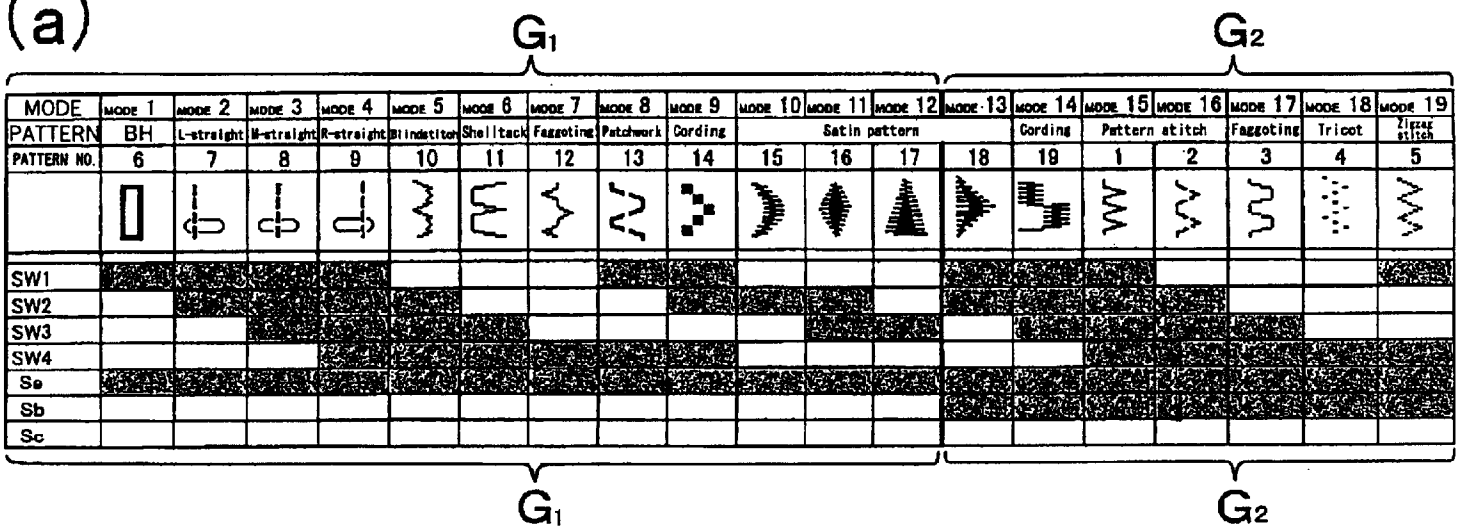
Figure 5B:
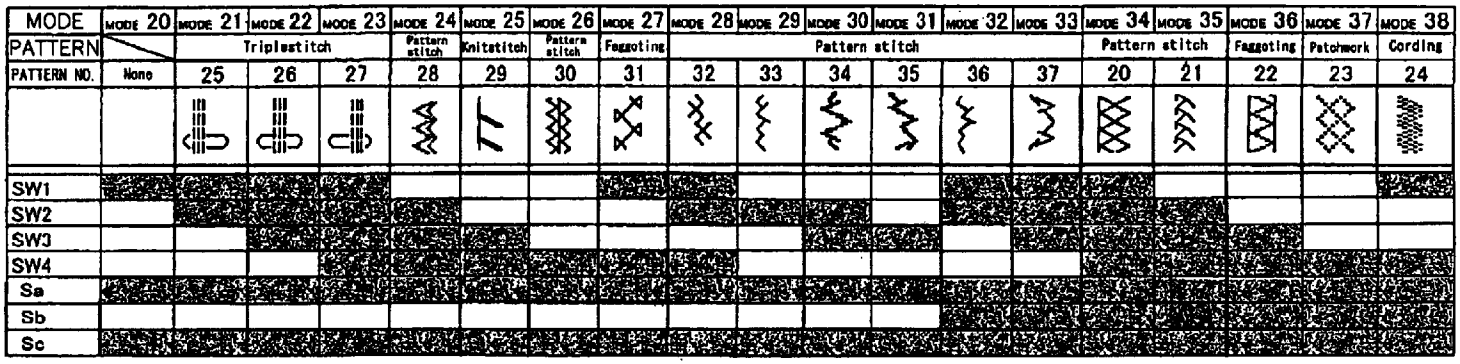

As shown in FIG. 5, according to the embodiment, the first pattern group $G_1$ includes 12 patterns and the second pattern group $G_2$ includes 7 patterns. Each pattern group may include a maximum number of 16 patterns.

According to the embodiment, the pattern group is changed over from $G_1$ to $G_2$ when the pattern group changing switch Sb is turned on as the rotational disk 2*b* is rotated by an angular distance as defined by 12 projections 2*c* from the initial position. The on-signal of the switch Sb is transmitted to the signal producing apparatus 20 in which a code signal is partly formed.

With rotation of the dial 5, the rotational disk 2*b* of the mode switch 2 is rotated and the projections 2*c* turn on the detecting switches $Sw_1$–$Sw_4$ in appropriate combination and a desired pattern may be selected from the pattern group $G_1$ or $G_2$ and indicated at the electronic indicator 10.

The changeover between the first pattern group $G_1$ and the second pattern group $G_2$ is made by the changeover cam 6 and the lever 7. Namely as the dial 5 is rotted, the changeover cam 6 activates the lever 7 to act on the pattern group changeover switch Sb. The pattern group changeover switch Sb is then turned on to change the pattern selection range from the first pattern group $G_1$ to the second pattern group $G_2$. The changeover cam 6 has a radially small portion 6*a* and a radially large portion 6*b*. When one end 7*a* of the lever is in engagement with the radially small portion 6*a* of the cam 6, the pattern group changeover switch Sb is in off-condition. When one end 7*a* of the lever comes to engage the radially large portion 6*a* of the cam 6, the pattern group changeover switch Sb is turned on. The peripheral range of the radially small portion 6*a* corresponds to the range defined by 12 projections 2*c* numbered from a predetermined first one thereof, the projections 2*c* being arranged in the outermost circle on the rotational disk 2*b*. The peripheral range of the radially large portion 6*a* corresponds to the range defined by the other 7 projections 2*c*.

The lever 7, which is swingable at the center pivot 7*c* thereof, has the opposite end 7*b* which acts on the pattern group changeover switch Sw. As mentioned above, the changeover between the first pattern group $G_1$ and the second pattern group $G_2$ is made by the pattern changeover switch Sw which is turned on and off. As shown in FIG. 5(*a*), the pattern group changeover switch Sb is off in the range of the first pattern group $G_1$ while the pattern group changeover switch Sb is on in the range of the second pattern group $G_2$.

For example, in FIG. 5(*a*), when MODE3 (M Straight) is selected, the projections 2*c*,2*c*,2*c* become operative to turn on the detecting switches $SW_1$, $SW_2$, $SW_3$ respectively while the pattern group changeover switch Sb is off. When the confirmation switch Sa is turned on, the code signal is produced from the signal producing apparatus 20 and simultaneously the selected MODE is indicated at the electronic indicator 10.

According to the invention, there is provided a cloth feeding means which may be used to each of the selected patterns. The cloth feeding means may be called a special or super feeding means which cyclically repeats a cloth feeding operation for feeding a cloth forward a plurality of stitches and feeding the cloth backward one stitch. The super feeding means may be selected by operation of a feed selecting switch Sc. Precisely, the feed selecting switch Sc is turned on and off by operation of a feed changeover dial 8. A selected pattern may be modified with application of the specific feeding operation provided by the supper feeding means. The modified patterns are shown in FIG. 5(*b*).

According to the embodiment, the signal producing apparatus 20 produces a code signal having the on-signal of the feed selecting switch Sc added thereto.

The signal producing apparatus 20, therefore, produces a code signal of 7 bits of the detecting switches $Sw_1$–$Sw_4$ and of the switches Sa, Sb, Sc. However, the effective signal is of 6 bits because the confirmation switch Sa produces a synchronizing signal. Therefore, logically 64 types of patterns may be discriminated. However, according to the embodiment of the invention, 38 types of patterns maybe discriminated as shown in FIG. 5.

According to the conventional pattern selecting device of dial operation type, it is very difficult to obtain exact pattern selecting operation in case the number of patterns is increased because the rotation angle is required to be rather small, this failing to get an exact angular position and often resulting in production of error signals. However, according to the invention, a plurality of projections 2*c* are properly arranged radially of the center axis of the rotational disk 2*b* for obtaining code signals without errors.

Further as the changeover between the patterns to be selected are correctly made and the selected pattern is indicated at the indicator, the wrong pattern selection and wrong operation may be avoided. Further with operation by way of the dial, many patterns may be optionally selected and indicated. Therefore, the machine user long accustomed to the rotational operation by way of a dial will feel easy in operation of the device as compared with a button operation or a touch panel operation.

Incidentally, the pattern selecting device is described above as a mechanical one using pattern cams. However an electronic pattern selecting device may be employed for forming a selected pattern o the basis of digital pattern data, wherein the code signal from the signal producing apparatus 20 is used for pattern selection as well as pattern indication.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A sewing machine having a dial provided therewith to be operated to select patterns to be stitched, said sewing machine comprising:

a signal producing means which is activated in association with operation of said dial to produce a code signal for a selected pattern;

a pattern indicating means which is activated in response to said code signal to indicate the selected pattern thereat; wherein said signal producing means includes a plurality of switches arranged in circles coaxial with said dial, said switches being turned on and off to produce said code signal as said dial is rotated.

2. The sewing machine as defined in claim 1, wherein said plurality of switches include the switches arranged in an outermost circle in number corresponding to the number of patterns which may be selected, said number of switches being turned on to make effective the code signal which is produced by the switches of the other coaxial circles which are turned on and off.

3. The sewing machine as defined in claim 1, wherein said plurality of switches are operated to turn on and off by a plurality of projections which are arranged in circle coaxial with said dial on the rear side thereof.

4. A sewing machine as defined in claim 1 further comprising:

a pattern selecting mechanism which is operated in association with operation of said dial to select one of a plurality of patterns;

said pattern indicating means which is activated in response to said code signal indicates the pattern selected by said pattern selecting mechanism.

5. The sewing machine as defined in claim 1 further comprising:

a means which is activated in response to said code signal to supply the pattern data designated by said code signal;

a pattern stitching mechanism which is operated in response to said pattern data to carry out a pattern stitching operation.

6. A sewing machine having a dial provided therewith to be operated to select patterns to be stitched, said sewing machine comprising:

a signal producing means which is activated in association with operation of said dial to produce a code signal for a selected pattern;

a pattern indicating means which is activated in response to said code signal to indicate the selected pattern thereat, wherein the patterns which may be selected are divided in a plurality of groups, said sewing machine further comprising pattern group selecting means for optionally selecting the pattern group, and wherein said dial is operated to optionally select the patterns of a selected pattern group, and wherein said signal producing means produces a cocie signal having a signal added thereto which is corresponding to a selected pattern group.

7. A sewing machine as defined in claim 6, further comprising:

a pattern selecting mechanism which is operated in association with operation of said dial to select one of a plurality of patterns;

wherein said pattern indicating means which is activated in response to said code signal indicates the pattern selected by said pattern selecting mechanism.

8. The sewing machine as defined in claim 6, further comprising:

a means which is activated in response to said code signal to supply the pattern data designated by said code signal;

a pattern stitching mechanism which is operated in response to said pattern data to carry out a pattern stitching operation.

9. A sewing machine having a dial provided therewith to be operated to select patterns to be stitched, said sewing machine comprising:

a signal producing means which is activated in association with operation of said dial to produce a code signal for a selected pattern;

a pattern indicating means which is activated in response to said code signal to indicate the selected pattern thereat, a feed selecting means which is operated to select a cloth feeding operation which is different than the cloth feeding operation of normal stitching mode, and wherein said signal producing means produces a code signal having a signal added thereto corresponding to the cloth feeding operation selected by said feed selecting means.

10. A sewing machine as defined in claim 9, further comprising:

a pattern selecting mechanism which is operated in association with operation of said dial to select one of a plurality of patterns;

wherein said pattern indicating means which is activated in response to said code signal indicates the pattern selected by said pattern selecting mechanism.

11. The sewing machine as defined in claim 9, further comprising:

a means which is activated in response to said code signal to supply the pattern data designated by said code signal;

a pattern stitching mechanism which is operated in response to said pattern data to carry out a pattern stitching operation.

* * * * *